US006276953B1

(12) United States Patent
Gauker et al.

(10) Patent No.: US 6,276,953 B1
(45) Date of Patent: Aug. 21, 2001

(54) ORIENTATIONLESS SQUIB CONNECTOR ASSEMBLY FOR AUTOMOTIVE AIR BAG ASSEMBLIES

(75) Inventors: Bradford K. Gauker, Clinton Township; David J. Rhein, Memphis, both of MI (US)

(73) Assignee: Thoma & Betts International, Inc., Sparks, NV (US)

( * ) Notice: Subject to any disclaimer, the term of this patent is extended or adjusted under 35 U.S.C. 154(b) by 0 days.

(21) Appl. No.: 09/197,748

(22) Filed: Nov. 23, 1998

Related U.S. Application Data

(60) Provisional application No. 60/067,538, filed on Dec. 4, 1997.

(51) Int. Cl.[7] ..... H01R 13/627

(52) U.S. Cl. ..... 439/352; 439/675; 439/188

(58) Field of Search ..... 439/352, 353, 439/675, 555, 557, 483, 552, 188; 200/51.1

(56) References Cited

U.S. PATENT DOCUMENTS

| | | | |
|---|---|---|---|
| 3,869,191 | 3/1975 | Tolnar, Jr. et al. | 339/111 |
| 3,971,320 | 7/1976 | Lee | 102/28 |
| 4,152,041 | 5/1979 | Hollyday et al. | 339/147 |
| 4,261,263 | 4/1981 | Coultas et al. | 102/28 |
| 4,306,499 | 12/1981 | Holmes | 102/202.4 |
| 4,380,346 | 4/1983 | Davis et al. | 280/736 |
| 4,696,705 | 9/1987 | Hamilton | 149/21 |
| 4,698,107 | 10/1987 | Goetz et al. | 149/7 |
| 4,806,180 | 2/1989 | Goetz et al. | 149/5 |
| 4,850,888 | 7/1989 | Denlinger et al. | 439/188 |
| 4,858,951 | 8/1989 | Lenzen | 280/741 |
| 5,027,707 | 7/1991 | Mei | 102/202.8 |
| 5,076,607 | 12/1991 | Woods et al. | 280/737 |
| 5,099,762 | 3/1992 | Drapala | 102/202.1 |
| 5,129,680 | 7/1992 | Mori | 280/806 |
| 5,131,680 | 7/1992 | Coultas et al. | 280/737 |
| 5,140,906 | 8/1992 | Little, II | 102/202.14 |
| 5,151,042 | 9/1992 | Okada | 439/169 |
| 5,184,846 | 2/1993 | Goetz | 280/736 |
| 5,200,574 | 4/1993 | Cunningham et al. | 102/530 |
| 5,203,719 | 4/1993 | Kozono | 439/489 |
| 5,213,362 | 5/1993 | Coultas | 280/736 |
| 5,226,667 | 7/1993 | Coultas | 280/734 |
| 5,242,194 | 9/1993 | Popek | 280/737 |
| 5,257,819 | 11/1993 | Frantom et al. | 280/737 |

(List continued on next page.)

FOREIGN PATENT DOCUMENTS

| | | |
|---|---|---|
| 196 17 792 A1 | 11/1997 | (DE) . |
| 0 477 044 A1 | 3/1992 | (EP) . |
| 0 791 987 A2 | 8/1997 | (EP) . |
| 2 310 087 A | 8/1997 | (GB) . |
| WO9807213 | 2/1998 | (WO) . |

*Primary Examiner*—Brian Sircus
*Assistant Examiner*—Son V. Nguyen
(74) *Attorney, Agent, or Firm*—Weingarten, Schurgin, Gagnebin & Hayes LLP

(57) ABSTRACT

An orientation less squib connector for an automotive air bag assembly is disclosed. The squib connector includes a connector configured to fit within a squib socket. A connector position assurance member (CPA) is mounted on the connector body for movement between an open position and a closed position. The CPA includes an abutment member positioned to abut against a portion of the connector body to prevent movement of the connector position assurance member out of the open position. The CPA also includes a flexural member configured to abut against the socket to deflect the flexural member and the abutment member out of abutment with the portion of the connector body, whereby the connector position assurance member is movable to the closed position to prevent removal of the connector from the socket.

16 Claims, 18 Drawing Sheets

U.S. PATENT DOCUMENTS

| | | | |
|---|---|---|---|
| 5,259,643 | 11/1993 | Kraft et al. | 280/740 |
| 5,273,312 | 12/1993 | Coultas et al. | 280/737 |
| 5,297,976 | 3/1994 | VarDerStuyf et al. | 439/271 |
| 5,334,025 | 8/1994 | Föhl | 439/188 |
| 5,345,875 | 9/1994 | Anderson | 102/530 |
| 5,351,988 | 10/1994 | Bishop et al. | 280/737 |
| 5,351,989 | 10/1994 | Popek et al. | 280/737 |
| 5,383,388 | 1/1995 | Ono | 89/1.14 |
| 5,389,751 | 2/1995 | Breed | 200/61.45 |
| 5,401,180 | 3/1995 | Muzslay | 439/188 |
| 5,406,889 | 4/1995 | Letendre et al. | 102/201 |
| 5,417,312 | 5/1995 | Tsuchitani et al. | 188/181 A |
| 5,427,030 | 6/1995 | Kidd et al. | 102/202 |
| 5,458,371 | 10/1995 | Fulmer et al. | 280/741 |
| 5,466,420 | 11/1995 | Parker et al. | 422/164 |
| 5,468,017 | 11/1995 | Kirsch et al. | 280/741 |
| 5,481,139 | 1/1996 | Lucas | 307/9.1 |
| 5,482,316 | 1/1996 | Lang et al. | 280/741 |
| 5,483,896 | 1/1996 | Hock et al. | 102/530 |
| 5,494,450 | 2/1996 | Kirsch et al. | 439/188 |
| 5,498,164 | 3/1996 | Ward et al. | 439/15 |
| 5,503,806 | 4/1996 | Fulmer et al. | 422/164 |
| 5,528,161 | 6/1996 | Liken et al. | 324/760 |
| 5,529,334 | 6/1996 | Meduvsky et al. | 280/738 |
| 5,613,865 | 3/1997 | Dullin et al. | 439/188 |
| 5,616,045 | 4/1997 | Gauker | 439/352 |
| 5,653,606 | 8/1997 | Chrysostomou | 439/352 |
| 5,993,230 * | 11/1999 | Gauker et al. | 439/188 |

* cited by examiner

ORIENTATIONLESS SQUIB CONNECTOR ASSEMBLY FOR AUTOMOTIVE AIR BAG ASSEMBLIES

CROSS REFERENCE TO RELATED APPLICATIONS

This application claims the benefit under 35 U.S.C. § 119(e) of U.S. Provisional Patent Application No. 60/067,538, filed on Dec. 4, 1997, entitled Orientationless Squib Connector, the disclosure of which is incorporated by reference herein.

This application is related to U.S. patent application Ser. No. 08/908,066, filed on Aug. 11, 1997, now U.S. Pat. No. 5,993,230, entitled "Orientationless Squib Connector Assembly for Automotive Air Bag Assemblies," the disclosure of which is incorporated by reference herein.

STATEMENT OF FEDERALLY SPONSORED RESEARCH OF DEVELOPMENT

N/A

BACKGROUND OF THE INVENTION

Supplemental inflatable restraints or air bag assemblies are becoming increasingly common as a safety device in vehicles throughout the world. The assembly comprises an inflatable canister located in the steering column, the passenger-side dashboard, the side door panel, or seat. Upon a sufficiently great deceleration, the canister is inflated by an explosive device known as a squib which contains a gun powder-based material. The squib is fired electronically upon a signal sent via wires from a deceleration or other sensor in the vehicle. The wires are attached to the squib via a squib connector which plugs into the squib socket.

A common form of squib assembly has two pins which extend within the socket, and an associated connector has two terminals which are in electrical contact with the pins when the connector is plugged into the socket. When the connector is removed from the socket, typically for servicing the inflation canister, a shorting clip or shunt is biassed into electrical contact with the two pins to form an electrical connection therebetween to reduce the risk of misfiring, for example, by static electricity. The connector urges the shorting clip out of electrical contact with the pins when the connector is plugged into the socket.

During manufacture of a two-pin squib assembly, two rotational orientation concerns must be addressed. The pins must located at the correct clocking position relative to the connector and the squib. Also, the pins must be parallel to each other and perpendicular to the socket floor, or the entire assembly must be discarded. Also, during assembly of the vehicle, the vehicle manufacturer must be concerned about routing of the wires. A keying feature must be provided to ensure proper orientation of the assembly.

Other prior art air bag connectors are shown in U.S. Pat. Nos. 5,334,025 and 5,401,180.

SUMMARY OF THE INVENTION

The present invention provides a single-pin squib connector assembly which has no required rotational orientation. An orientationless squib connector for an automotive air bag assembly comprises a connector body having a cylindrical portion, defining a central axis, configured to fit in mating engagement within a squib socket. A first electrically conductive terminal is symmetrically located about the central axis within the cylindrical portion. A second electrically conductive terminal is radially offset from the electrically conductive terminal with respect to the central axis and comprises a depending beam having a contacting surface at a free end thereof. A cover is fixed to the connector body.

A connector position assurance member (CPA) is mounted on the connector body for movement between an open position and a closed position. The CPA includes an abutment member positioned to abut against a portion of the connector body to prevent movement of the connector position assurance member out of the open position. The CPA also includes a flexural member configured to abut against the socket to deflect the flexural member and the abutment member out of abutment with the portion of the connector body, whereby the connector position assurance member is movable to the closed position.

The connector body includes one or more latching arms having a catch thereon which fits within a groove on the socket. In one embodiment, the groove is located externally of the socket. In another embodiment the groove is located internally in the socket. To remove the connector from the socket, the latching arm is flexed to move the catch out of the groove. In the closed position, the CPA includes one or more depending arms that fit between the latching arm or arms and the rest of the connector body, preventing flexure of the latching arms and removal of the connector from the socket.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 2:
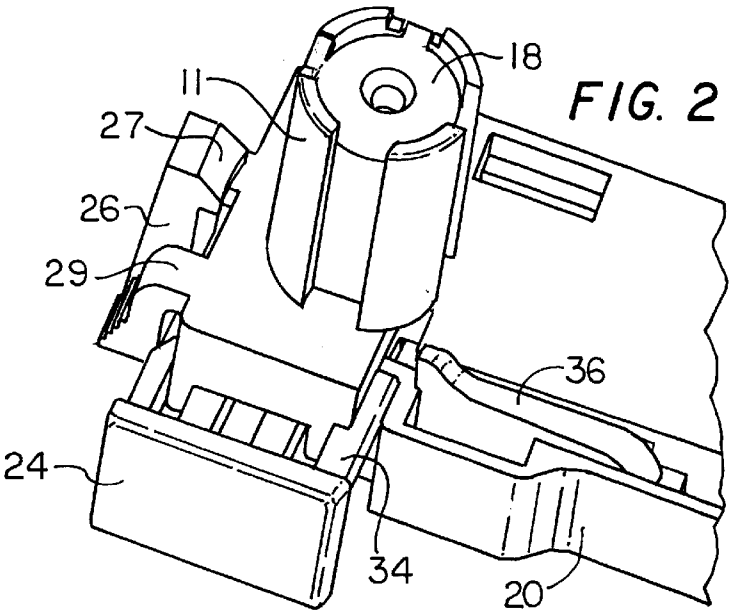
FIG. 2 is a partial isometric bottom view of the connector of FIG. 1.
Figure 4:
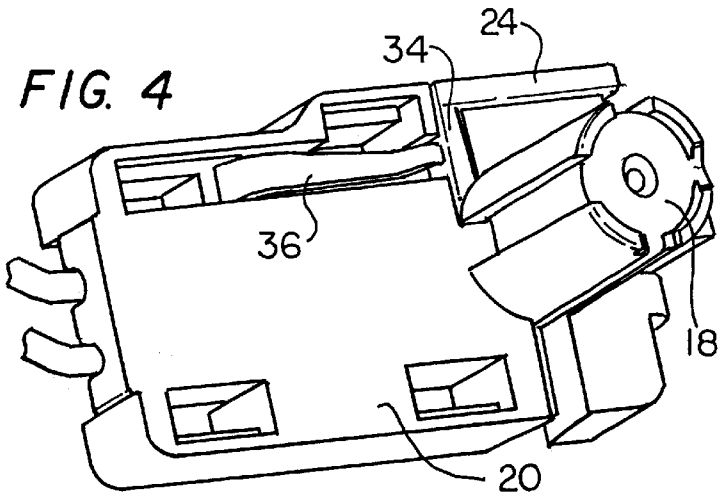
FIG. 4 is a bottom isometric view of the connector of FIG. 3.
Figure 1:
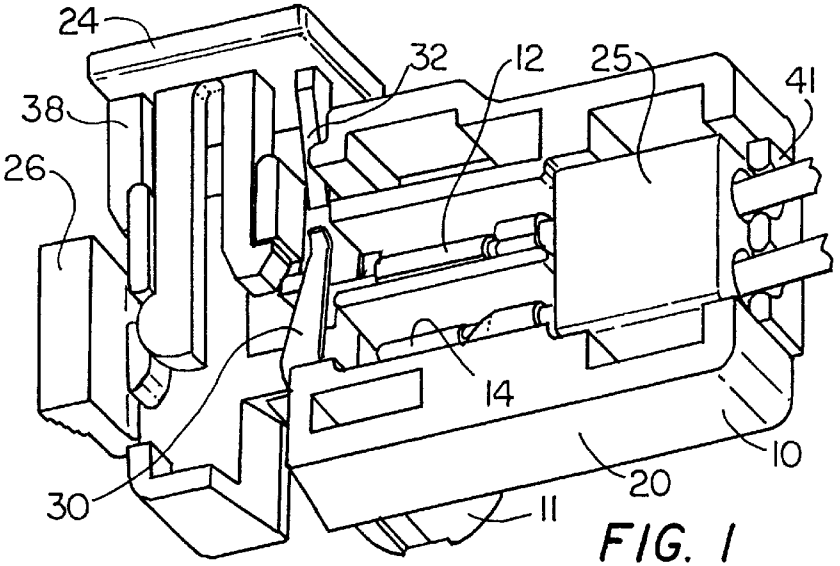
FIG. 1 is an isometric view of a first embodiment of an orientationless squib connector according to the present invention with the connector position assurance member (CPA) disengaged and the cover removed, for use with a socket having an external groove.
Figure 3:
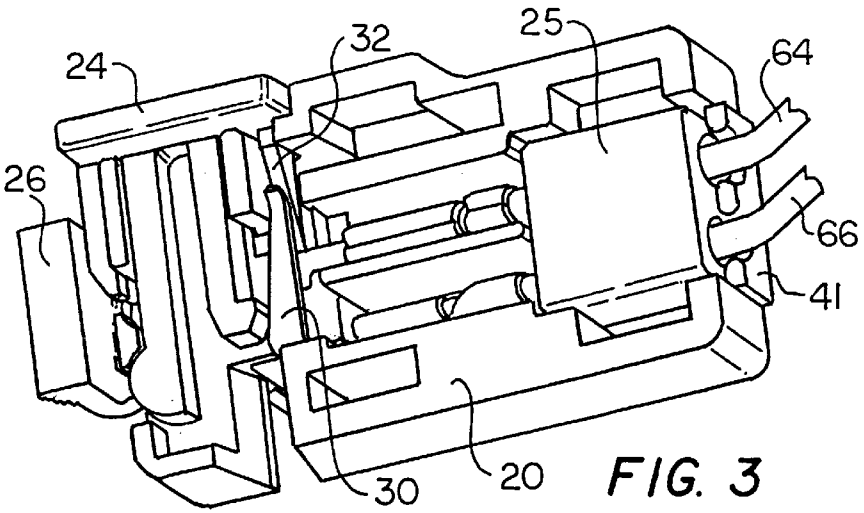
FIG. 3 is an isometric view of the connector of FIG. 1 with the CPA engaged.
Figure 5:
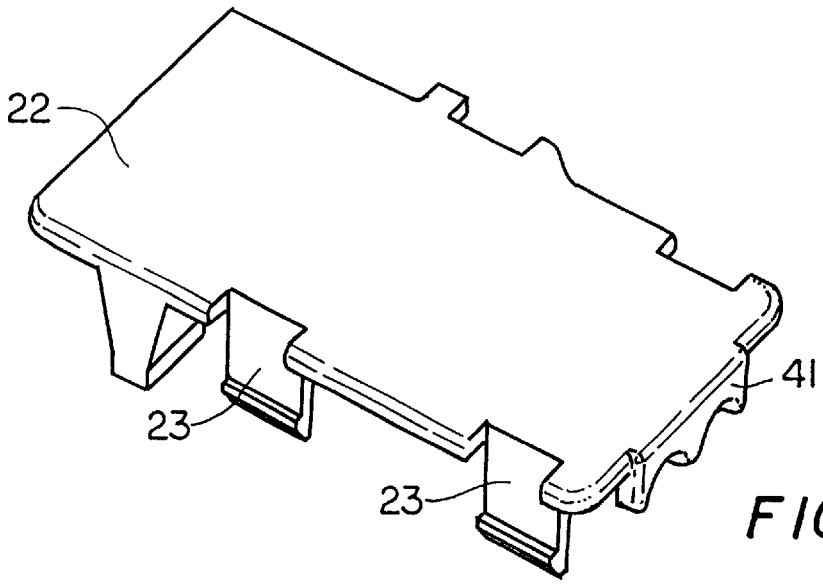
FIG. 5 is an isometric view of the cover of the connector of FIG. 1.
Figure 6:
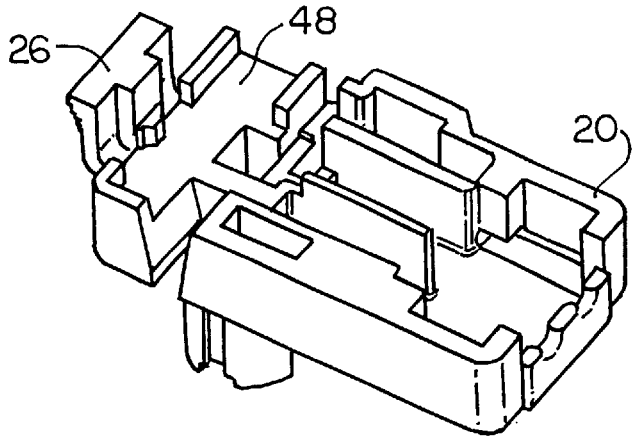
FIG. 6 is an isometric view of the connector body of the connector of FIG. 1.
Figure 7:
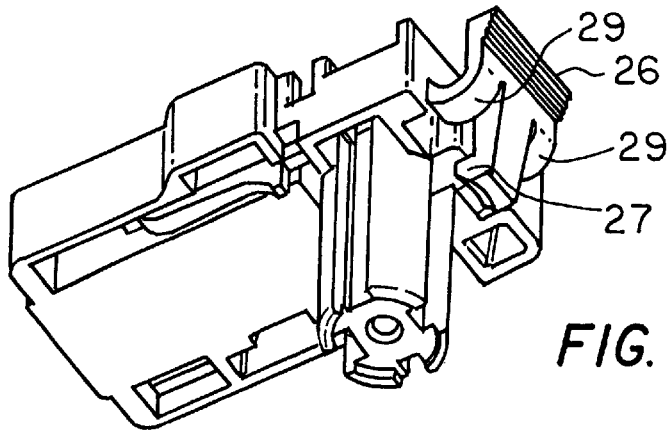
FIG. 7 is a bottom isometric view of the connector body of FIG. 6.
Figure 8:
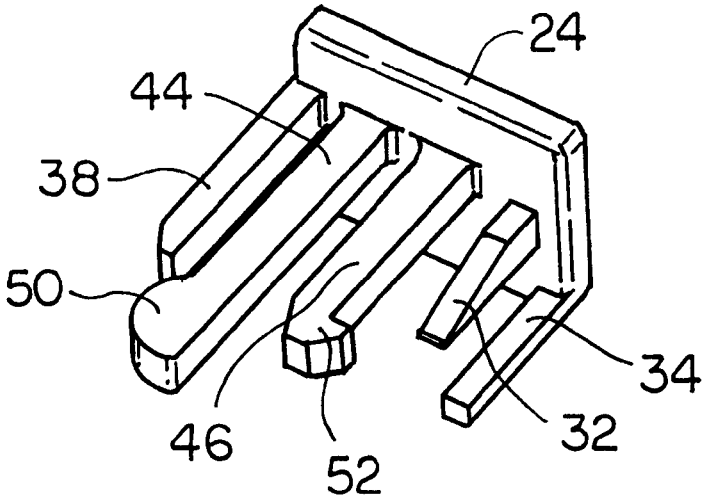
FIG. 8 is an isometric view of the CPA of the connector of FIG. 1.
Figure 9:
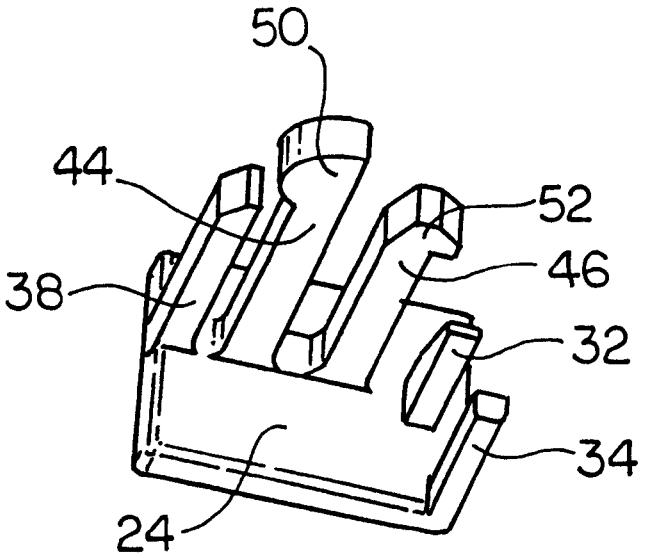
FIG. 9 is a bottom isometric view of the CPA of FIG. 8.
Figure 10:
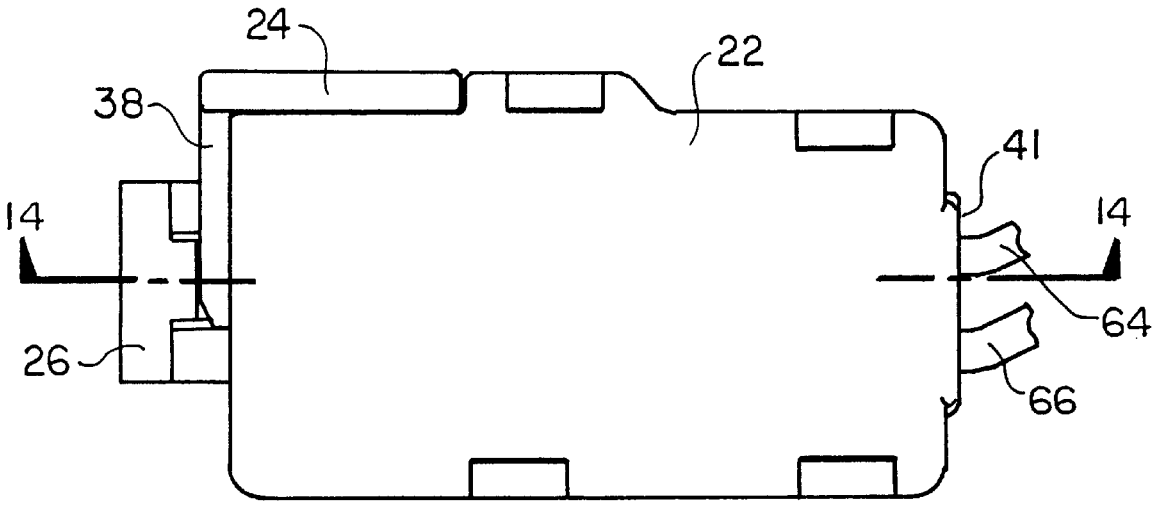
FIG. 10 is a top view of the connector of FIG. 1 with the cover attached.
Figure 11:
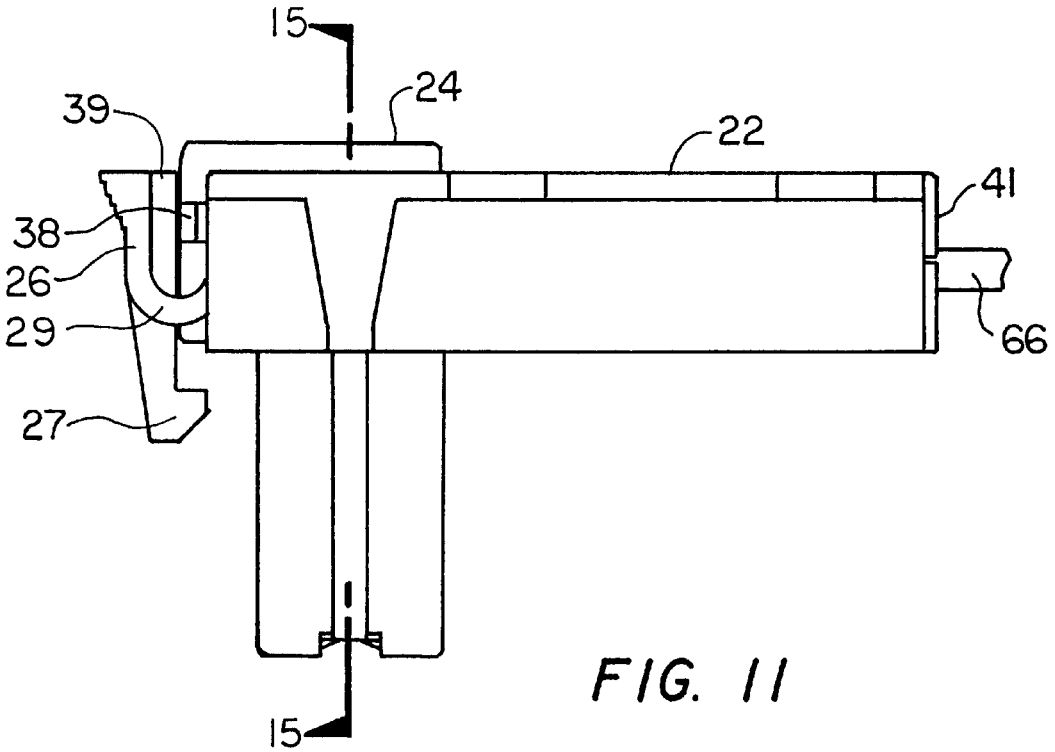
FIG. 11 is a side view of the connector of FIG. 10.
Figure 12:
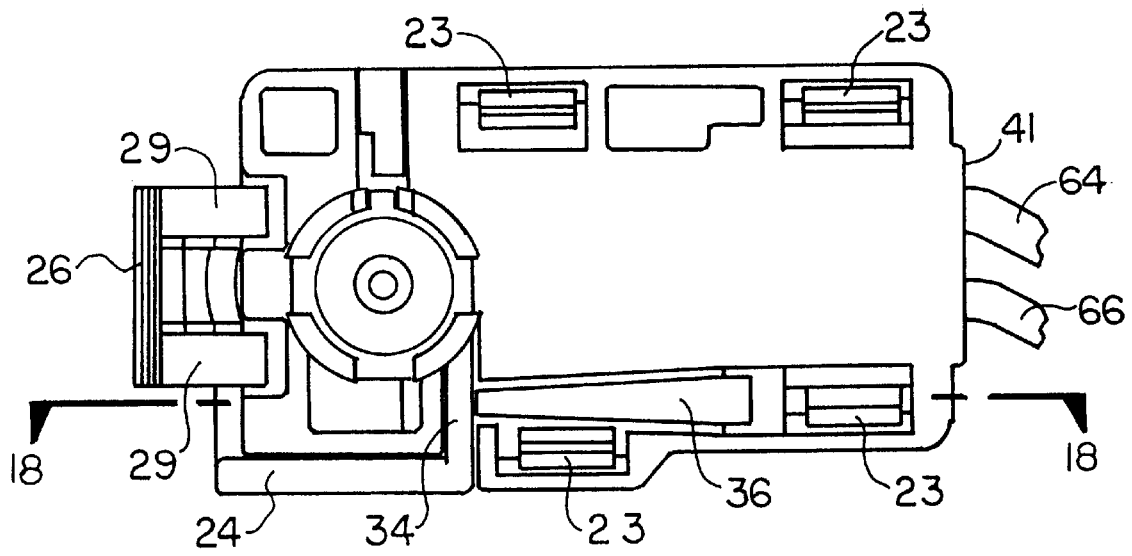
FIG. 12 is a bottom view of the connector of FIG. 10.
Figure 13:
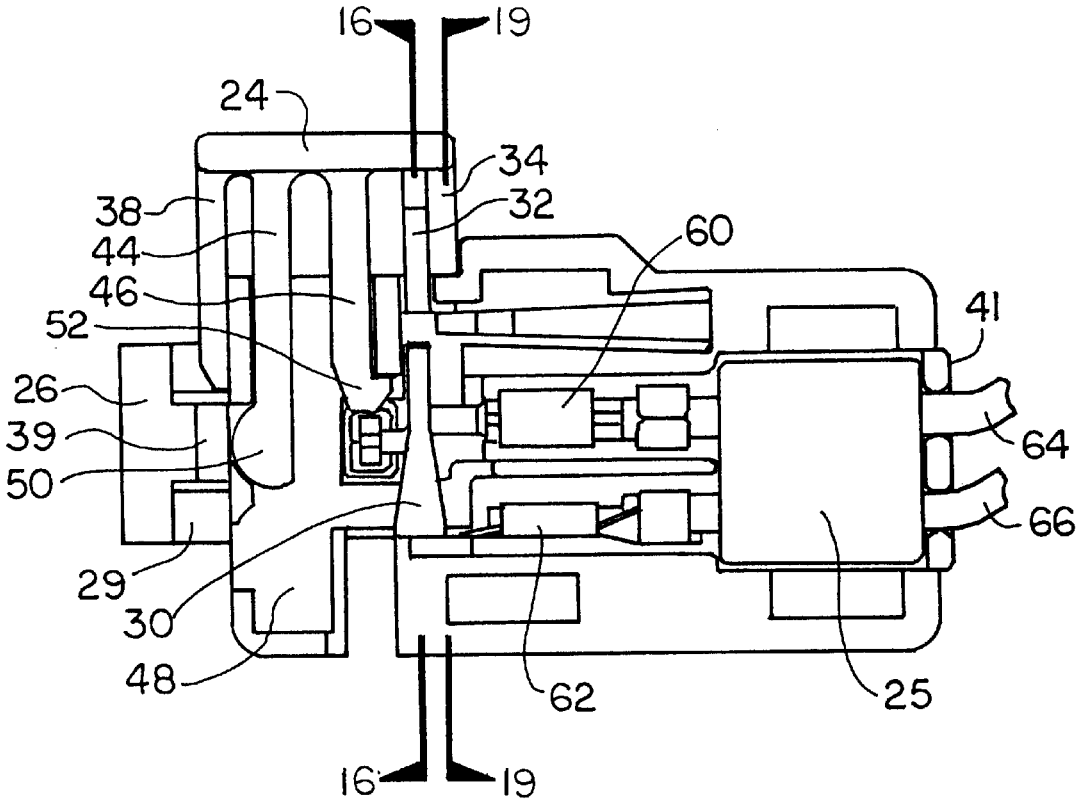
FIG. 13 is a top view of the connector of FIG. 1 with the cover omitted and the CPA disengaged.
Figure 14:
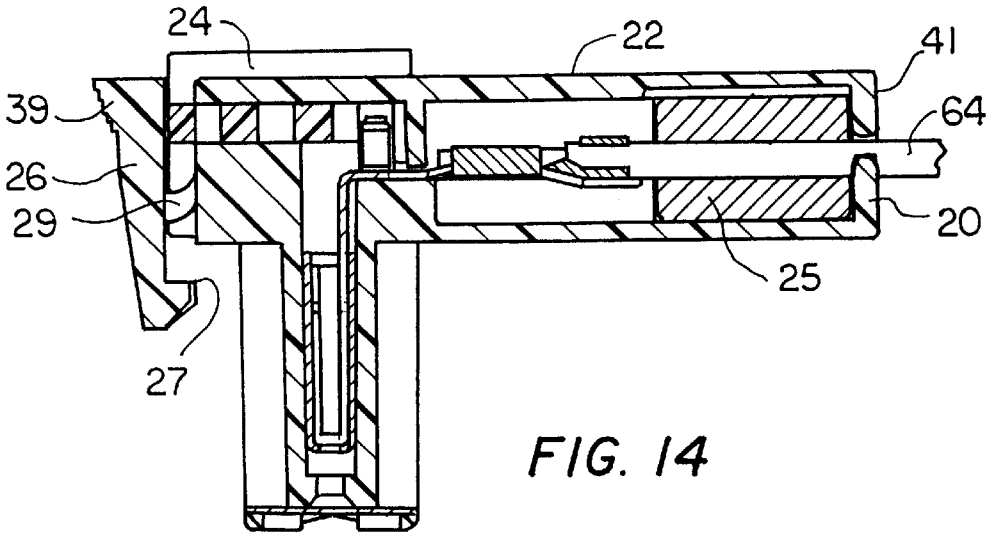
FIG. 14 is a sectional view along line 14—14 of FIG. 10.
Figure 16:
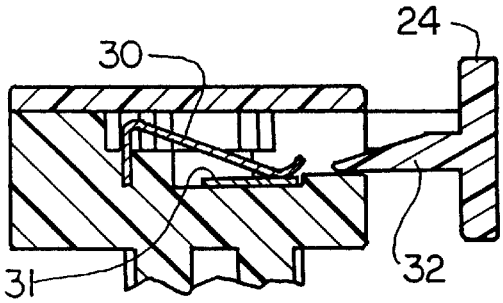
FIG. 16 is a sectional view along line 16—16 of FIG. 13 with the CPA disengaged.
Figure 15:
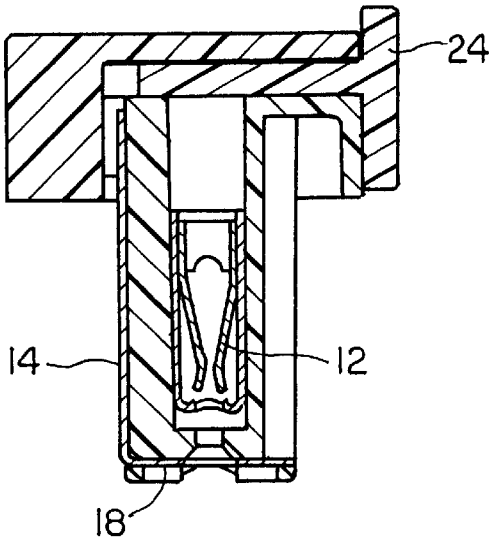
FIG. 15 is a sectional view along line 15—15 of FIG. 11.
Figure 17:
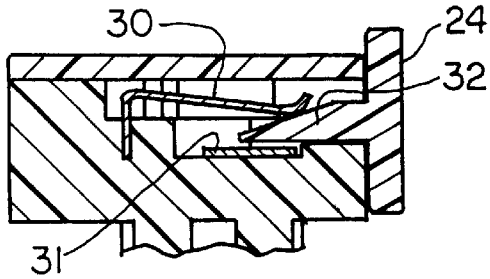
FIG. 17 is a sectional view along line 16—16 of FIG. 13 with the CPA engaged.
Figure 18:
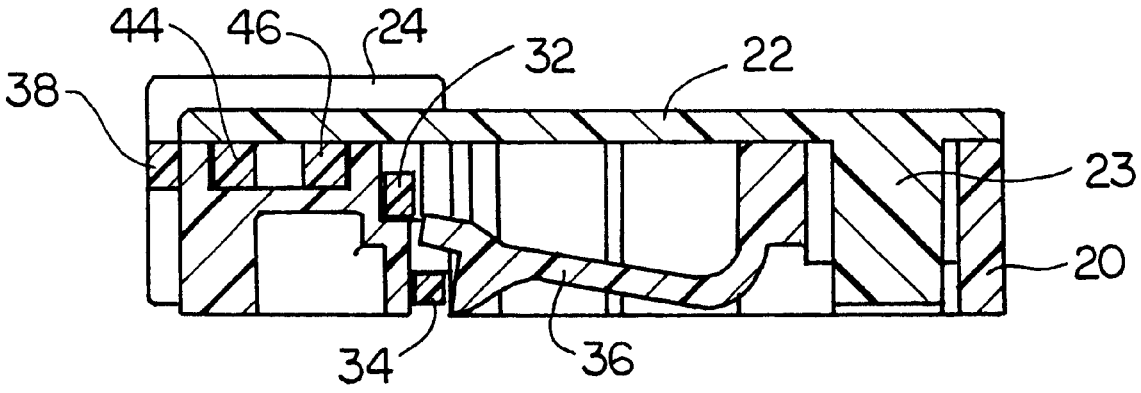
FIG. 18 is a sectional view along line 18—18 of FIG. 12 with the lockout beam deflected by the top edge of the socket (not shown)
Figure 19:
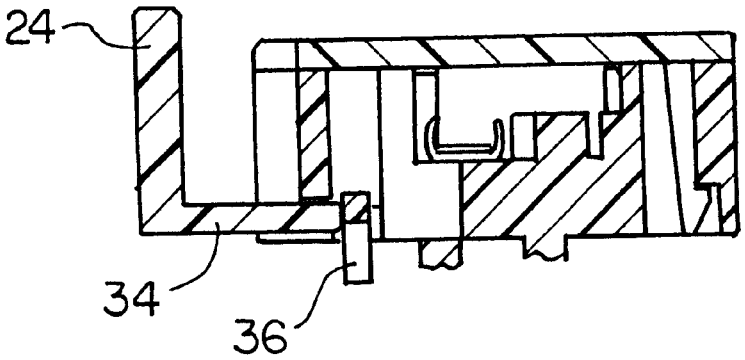
FIG. 19 is a sectional view along line 19—19 in which the lockout beam is not deflected.
Figure 20:
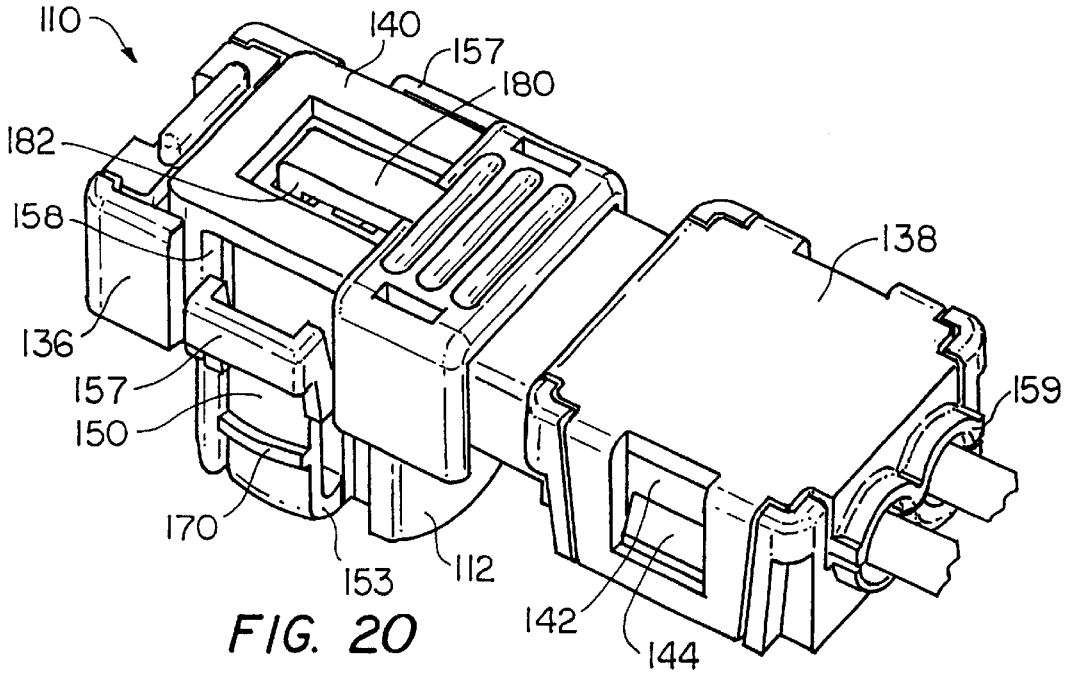
FIG. 20 is an isometric view of a second embodiment of an orientationless connector for use with a socket having an internal groove.
Figure 21:
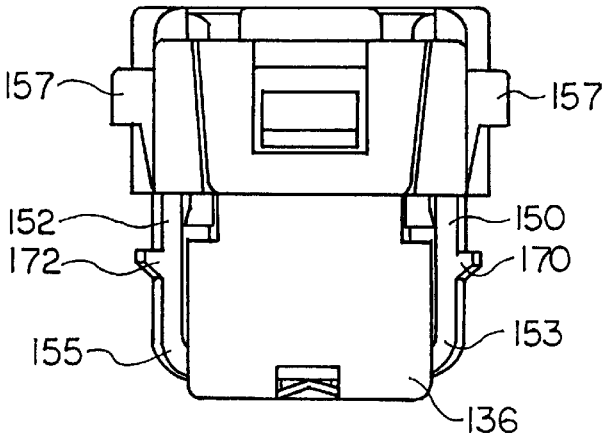
FIG. 21 is a side view of the connector of FIG. 20.
Figure 22:
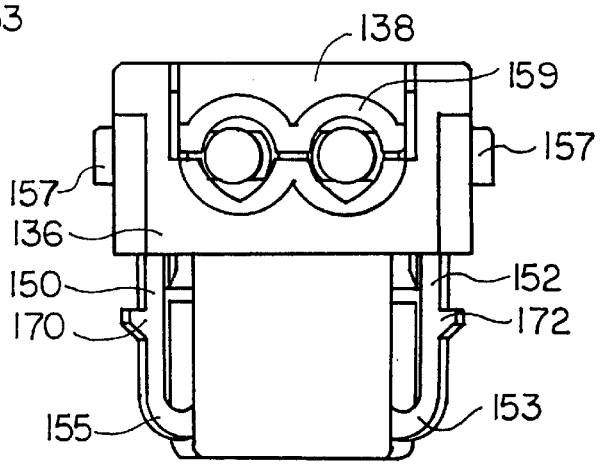
FIG. 22 is an opposite side view of the connector of FIG. 20.
Figure 23:
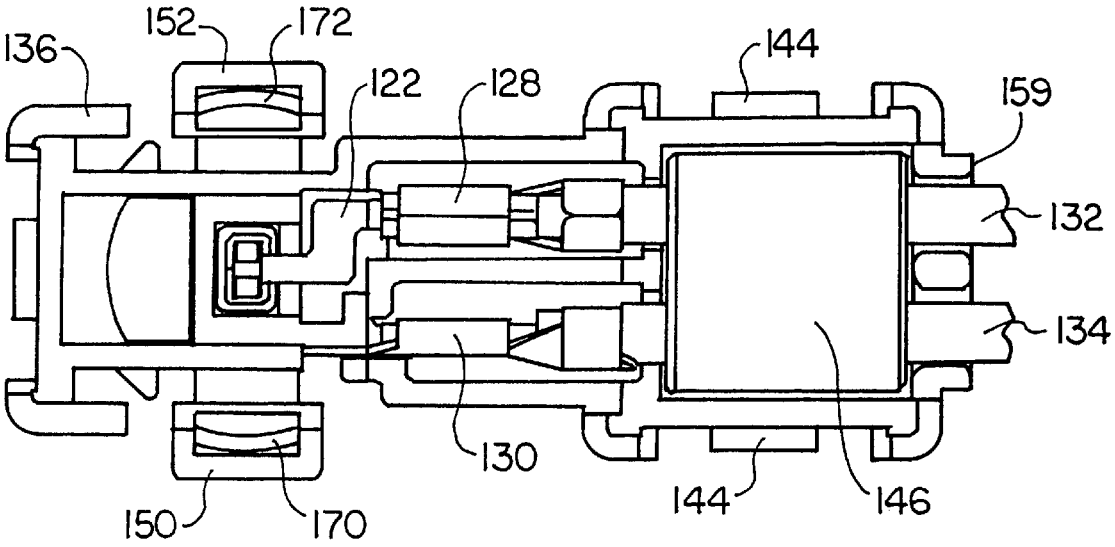
FIG. 23 is a top plan view of the body of the connector of FIG. 20.

The present invention provides a single-pin squib connector assembly which has no required rotational orientation.

In a first embodiment, illustrated in FIGS. 1 through 19, a connector 10 is provided for use with a single-pin squib assembly having an external latching groove around the cylindrical socket which receives the connector. In the socket, shown for example in U.S. Pat. No. 5,993,230, a first terminal is provided by a single axial pin extending along the central axis of the cylindrical socket and anchored to the initiator cup of the squib. A second terminal comprising a flat, radially extending ground plate annularly surrounds the pin and is fixed to the initiator cup within the socket. An external annular groove is provided around the socket, to which the connector attaches as described further below.

The connector includes a first or female terminal 12 comprising a pair of opposed beams which contact the pin in the socket when the connector is inserted into the socket. The connector also includes a second or ground terminal 14 having a depending beam radially offset from the pair of beams contacting the pin. A contacting ring 18 is formed at the end of the depending beam to surround the female terminal and the central pin in the socket. The contacting ring is able to contact the ground plate at 5 any rotational orientation with respect to the socket. The terminals include wire crimp sections 60, 62 which grip associated wires 64, 66 entering the connector.

The connector includes a connector body or housing 20, a cover 22, and a connector position assurance member or CPA 24. The wire crimp portions of the first and second terminals and the associated entering wires are sandwiched between the body and the cover. The cover attaches to the connector body in any suitable manner to prevent subsequent removal of the cover, such as with tabs 23.

The CPA 24 is slidable between an open position (FIGS. 1, 2, 13, 16, 19) and a closed position (FIGS. 3, 4, 10, 12, 15, 17, 18).

A latching arm 26 extends from the connector body 20. A catch 27 on the end of the latching arm latches to the external groove in the socket. When the connector is engaged in the socket, the CPA 24 is slidable to the closed position between the latching arm 26 and the rest of the connector body. In this position, the CPA ensures correct positioning of the connector in the socket and blocks flexure of the latching arm to disengage the catch 27 of the latching arm from the groove, so that the connector assembly cannot be removed from the socket. To remove the connector assembly, the CPA is pulled outwardly to disengage from the housing and unblock the latching arm. The latching arm is attached to the connector body with radial members 29 which flex and are configured to minimize stress on the connector body.

The female terminal includes a pad area 31 (see FIGS. 16 and 17) and the ground terminal includes a flexural beam 30 biassed to contact the pad area on the female terminal when the CPA 24 is not fully engaged in the closed position in the connector body. The CPA includes an arm or wedge 32 which pushes the flexural beam 30 away from the pad area 31 when the CPA is in the closed position in the connector body. In this way, when the CPA is in the open position, the terminals 12 and 14 are shorted by electrical contact between the flexural beam 30 and the pad area 31. Thus, electronic diagnostic testing can be performed during assembly to determine if a short circuit exists, rather than relying upon a visual inspection to see if the CPA is fully engaged in the closed position.

In this embodiment, the CPA also includes an arm or abutment member 34 which abuts against an end of a lockout beam or portion 36 on the connector body when the connector is not inserted into a squib socket, preventing the CPA from being pushed into the closed position with respect to the connector. When the connector body is inserted into the squib socket, the top edge of the socket contacts the lockout beam 36, pushing it up and out of abutment with the arm on the CPA. Once the lockout beam no longer abuts against the CPA, the CPA can be pushed into the closed position in the connector body.

The CPA includes another arm 38 which fits between the upwardly extending portion 39 of the latching arm 26 of the connector body, preventing the upwardly extending portion from being pivoted toward the wire entrance area 41 to unlatch the latching arm 26. In this manner, the CPA in the closed position prevents the connector body from being removed from the socket. Also, the CPA includes a pair of sliders 44, 46 which slide within a slot area 48 within the connector body 20. Protrusions 50, 52 on the sliders abut against faces on the connector body to limit travel of the CPA between the open and closed positions and prevent the CPA, once installed, from being fully removed from the cover.

Figure 45:
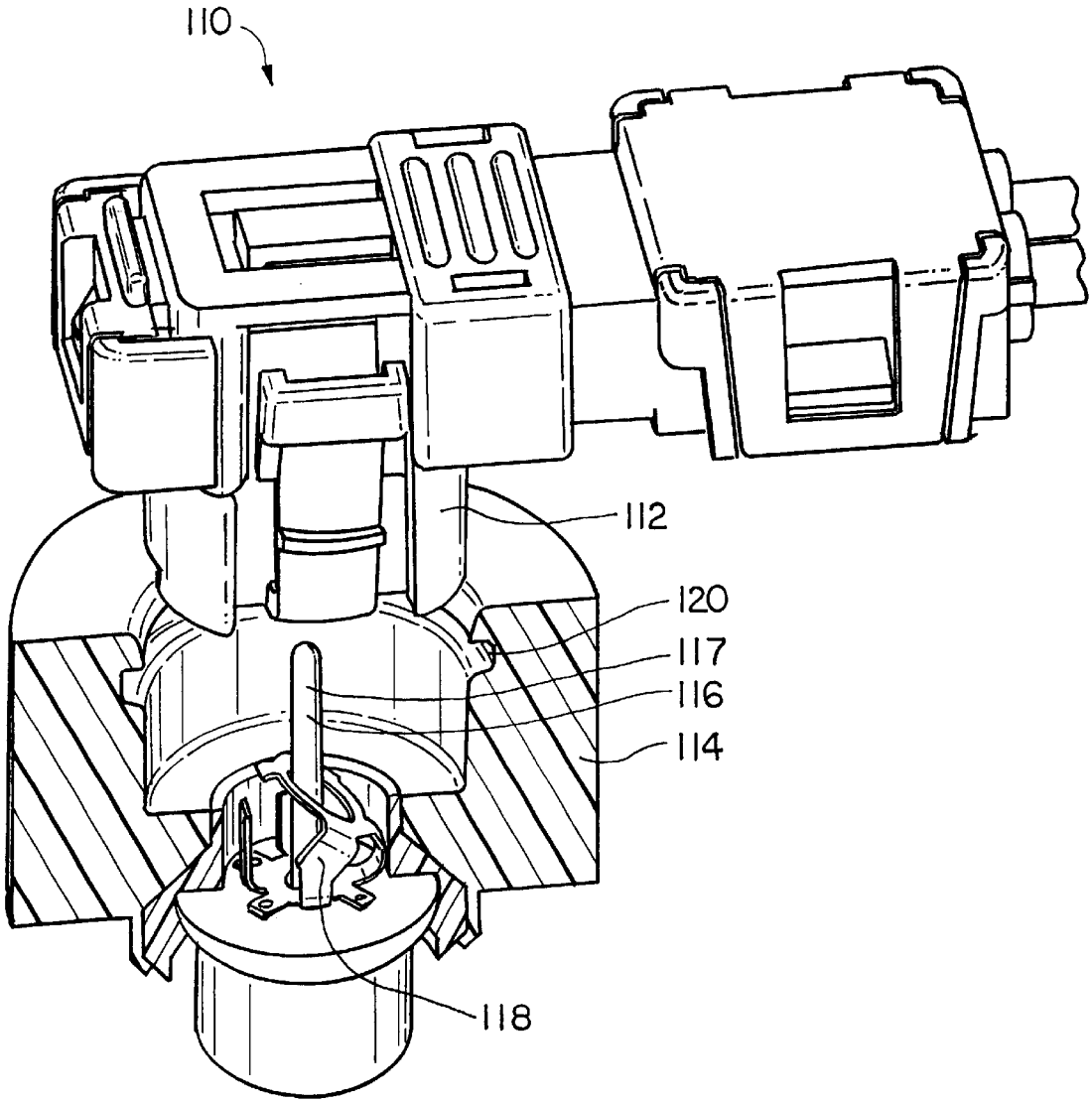
FIG. 45 is an isometric view of a connector and socket assembly.
Figure 46:
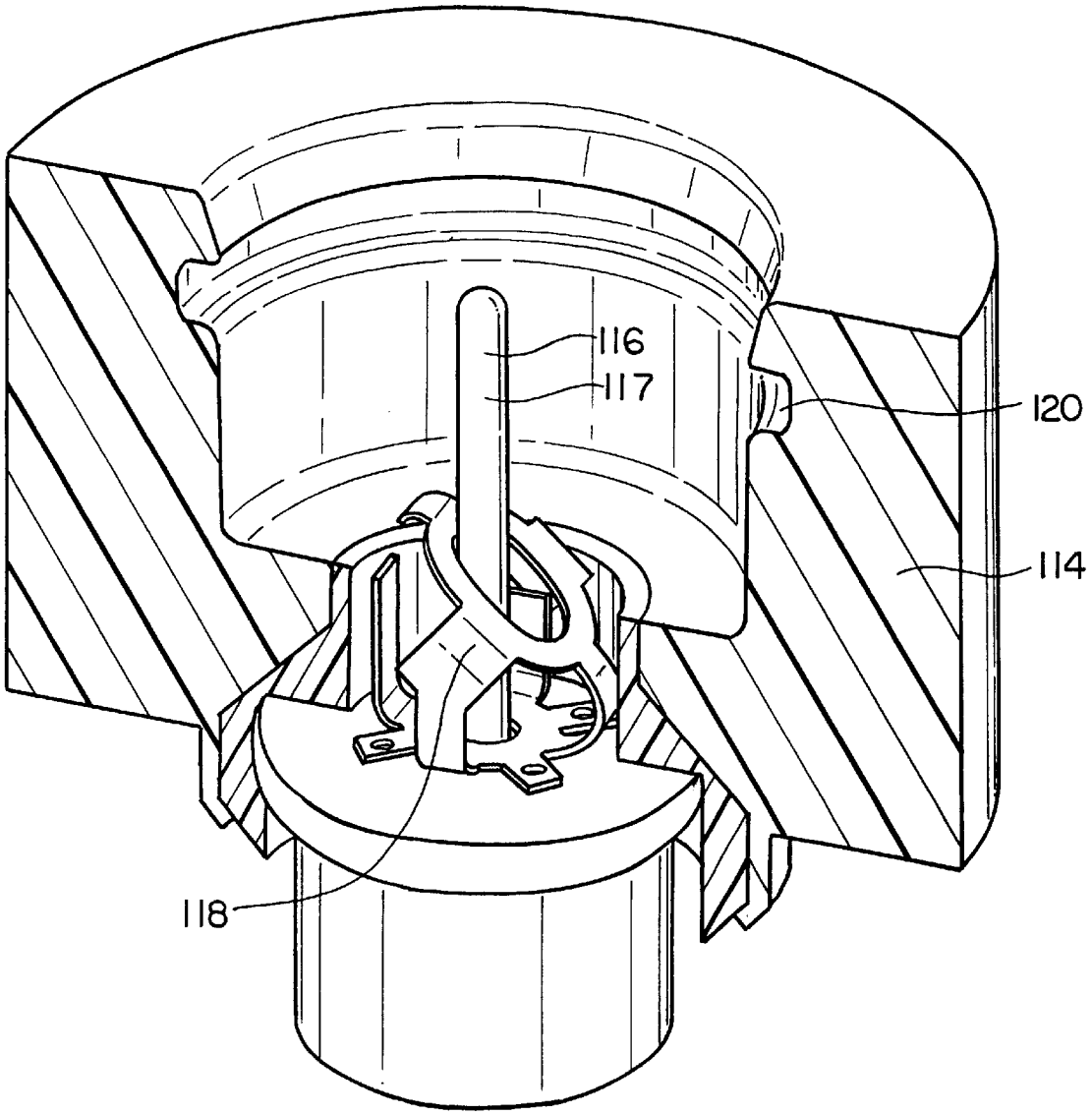
FIG. 46 is an isometric view of a squib socket assembly.

A further embodiment of an orientationless single-pin squib connector assembly for use with a single-pin socket having an internal annular latching groove is illustrated in FIGS. 20 through 46. The connector assembly includes a connector 110 having a depending cylindrical portion 112 for insertion within the socket 114 (see FIGS. 45 and 46). In the socket, a first terminal 116 is provided by a single axial pin 117 extending along the central axis of the cylindrical socket and anchored to the initiator cup of the squib. A second terminal 118 comprising a grounding clip annularly surrounds the pin and is fixed to the initiator cup within the socket. When the connector is not inserted into the socket, the grounding clip is biassed upwardly such that it makes electrical connection with the axial pin. When the connector is inserted into the socket, it pushes the grounding clip out of electrical contact with the axial pin. An annular groove 120 is provided internally within the socket to which the connector 110 latches, described further below.

The connector includes a first or female terminal 122 comprising a pair of opposed beams 124 which contact the pin 117 in the socket 114 when the connector is inserted into the socket. The connector also includes a second or ground terminal 126 having a depending beam radially offset from the pair of beams contacting the pin. A contacting ring 127 is formed at the end of the depending beam and bent from the position shown in FIG. 43 to surround the female terminal and the central pin in the socket. The contacting ring is able to contact the grounding clip 118 at any rotational orientation with respect to the socket. The terminals include wire crimp sections 128, 130 which grip associated wires 132, 134 entering the connector.

The connector includes a connector body or housing 136, a cover 138, and a connector position assurance member or CPA 140. The wire crimp portions 128, 130 of the first and second terminals and the associated entering wires 132, 134 are sandwiched between the body 136 and the cover 138. The cover attaches to the body in any suitable manner to prevent subsequent removal of the cover, such as by apertures 142 which receive tabs 144 on the body. A ferrite bead 146, as is known in the art, surrounds the wires 132, 134 in a suitably sized recess in the connector body 136.

Two latching arms 150, 152 extend from the connector body 136. Catches 170, 172 protrude from the latching arms to latch to the internal groove 120 in the socket. The latching arms are attached to the connector body with flexure members 153, 155 which flex to allow the upper portions 157 of the latching arms to be moved or flexed inwardly toward the center of the connector. When the upper portions are so flexed inwardly, the catches are displaced out of the groove and the connector can then be removed from the socket.

Figure 24:
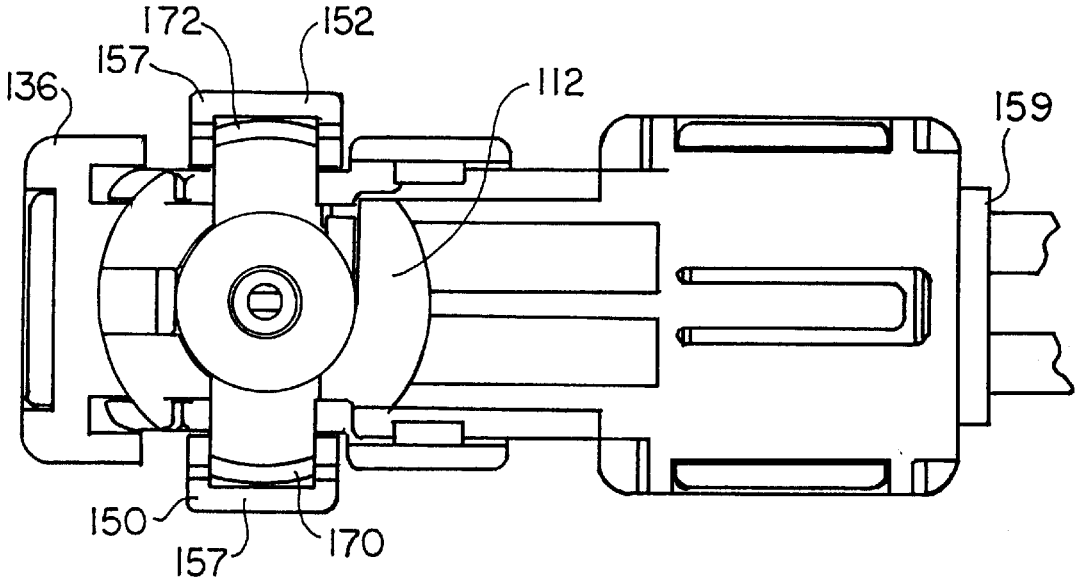
FIG. 24 is a bottom plan view of the body of FIG. 23.
Figure 25:
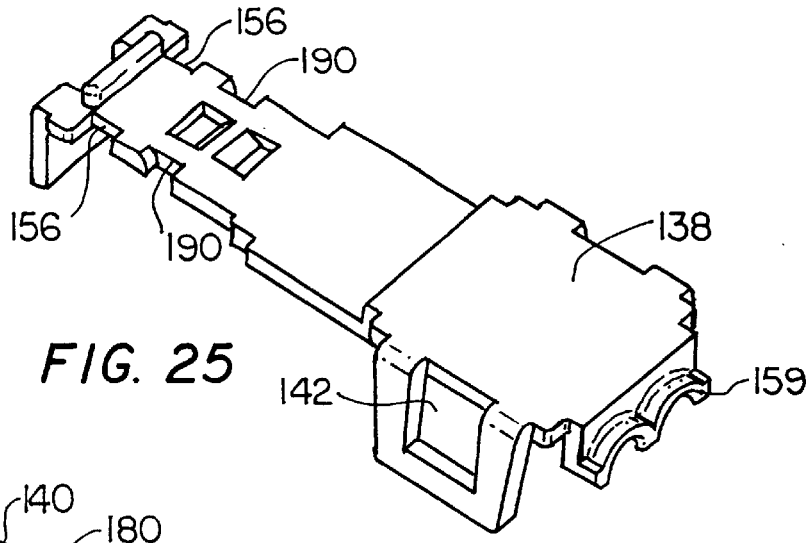
FIG. 25 is an isometric view of a cover for the connector of FIG. 20.
Figure 26:
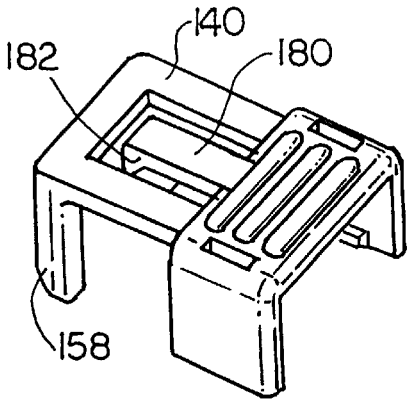
FIG. 26 is an isometric view of a connector position assurance member (CPA) of the connector of FIG. 20.
Figure 27:
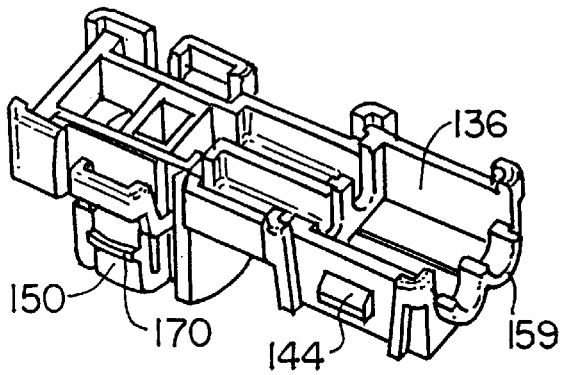
FIG. 27 is an isometric view of the body of the connector of FIG. 20.
Figure 28:
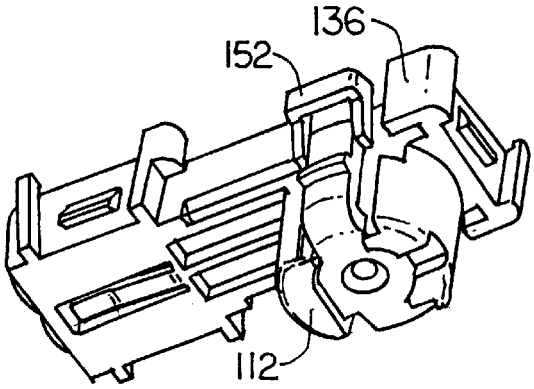
FIG. 28 is a bottom isometric view of the body of the connector of FIG. 27.
Figure 29:
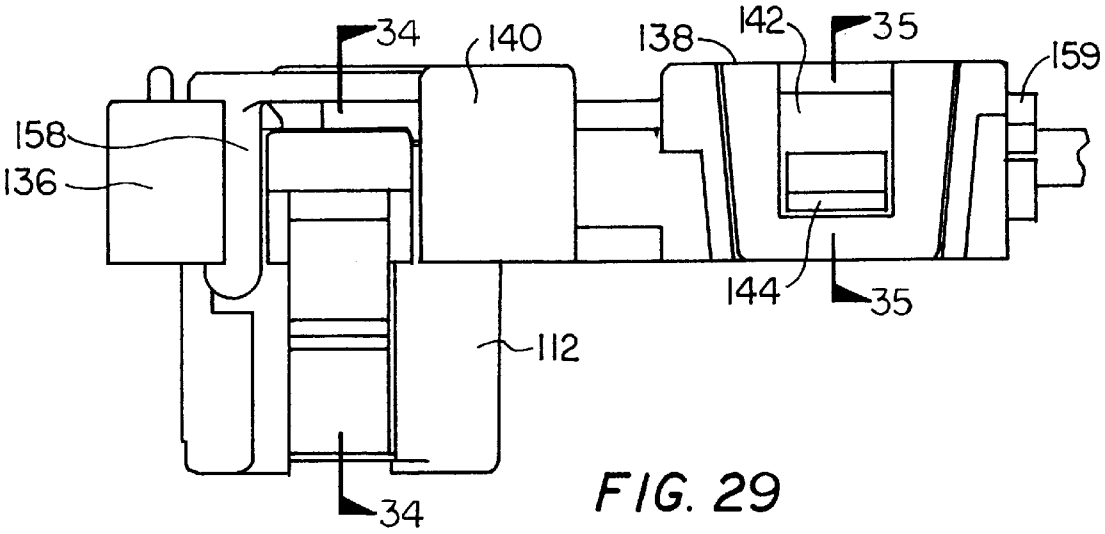
FIG. 29 is a side view of the connector of FIG. 20.
Figure 30:
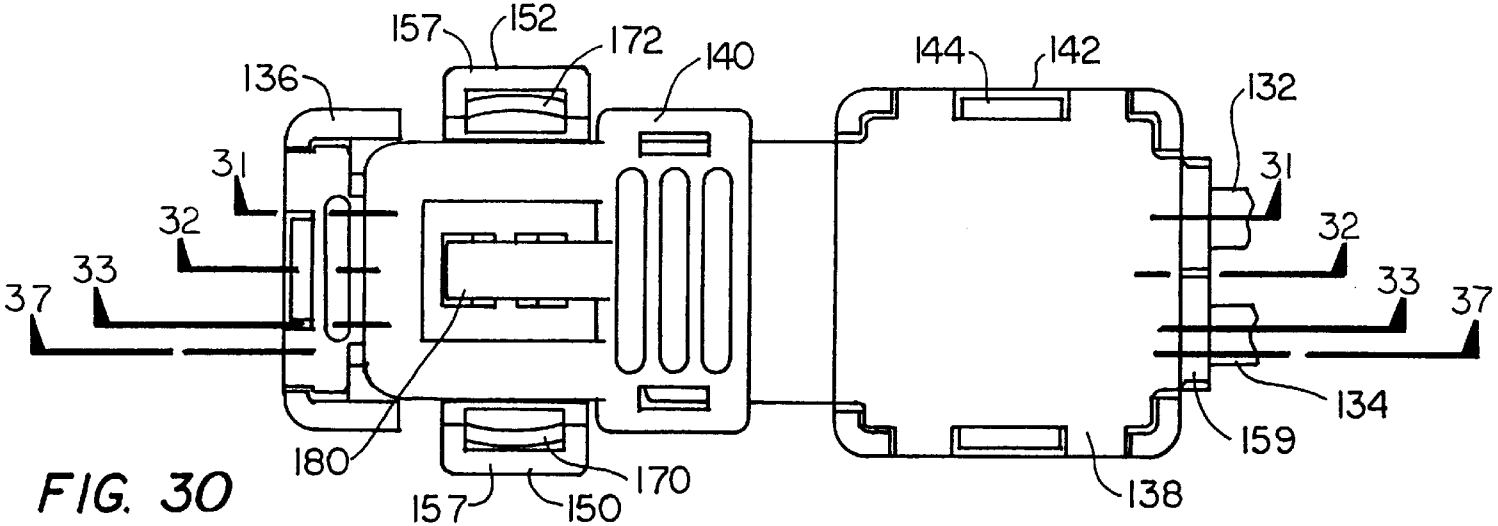
FIG. 30 is a top plan view of the connector of FIG. 20.
Figure 31:
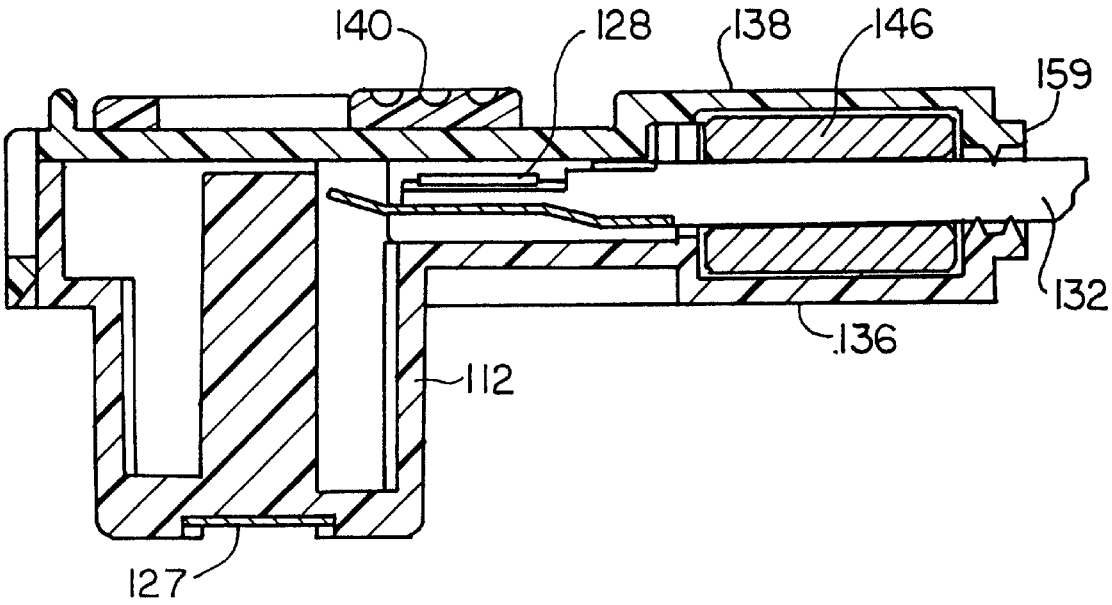
FIG. 31 is a cross-sectional view along line 31—31 of FIG. 30.
Figure 32:
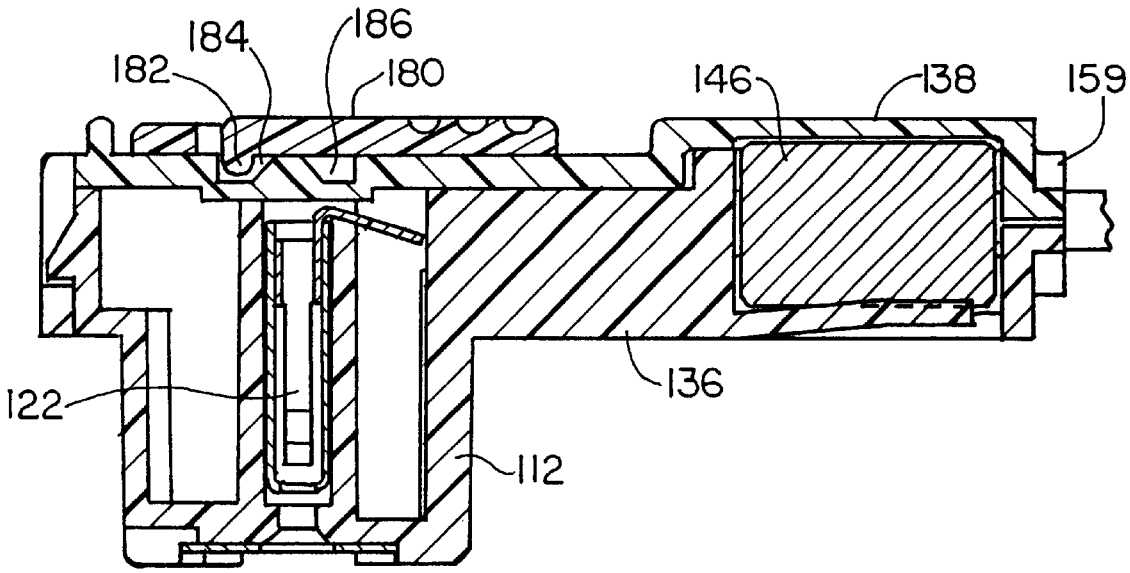
FIG. 32 is a cross-sectional view along line 32—32 of FIG. 30.
Figure 33:
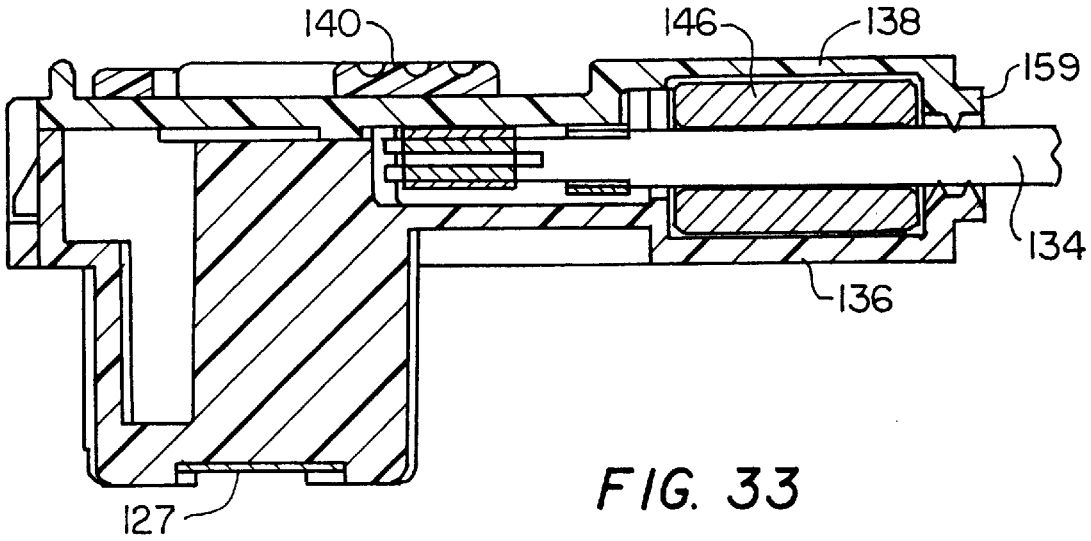
FIG. 33 is a cross-sectional view along line 33—33 of FIG. 30.
Figure 34:
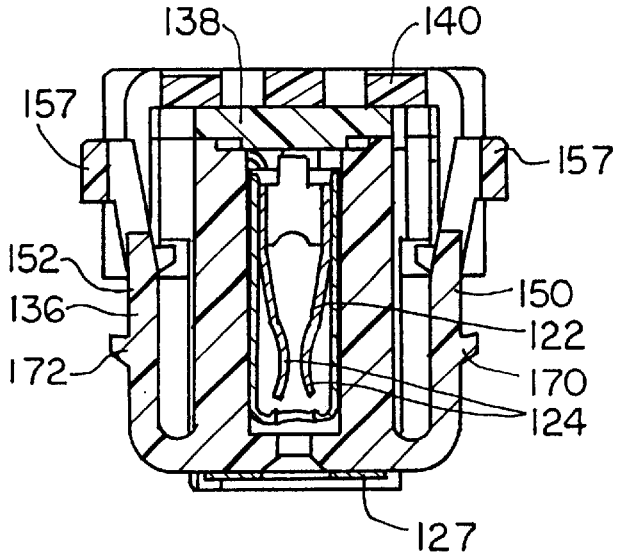
FIG. 34 is a cross-sectional view along line 34—34 of FIG. 29.
Figure 35:
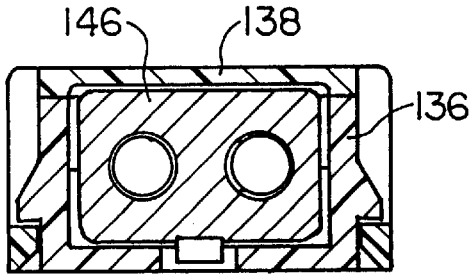
FIG. 35 is a cross-sectional view along line 35—35 of FIG. 29.
Figure 37:
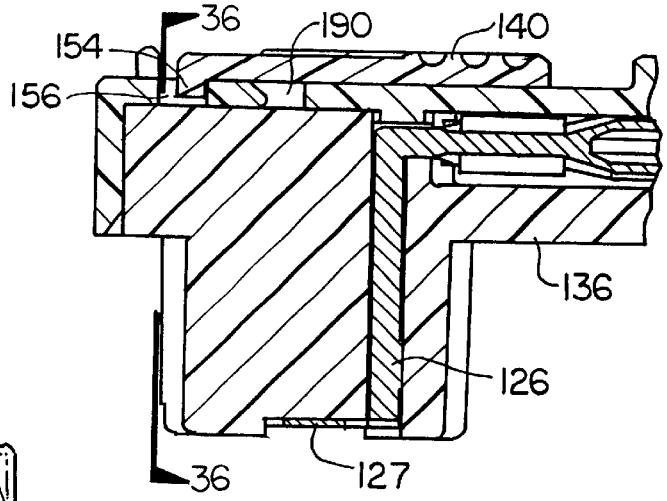
FIG. 37 is a partial cross-sectional view along line 37—37 of FIG. 30 showing the connector disengaged.
Figure 36:
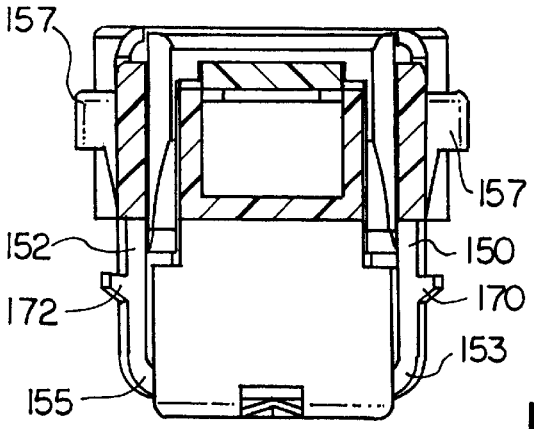
FIG. 36 is a cross-sectional view along line 36—36 of FIG. 37.
Figure 39:
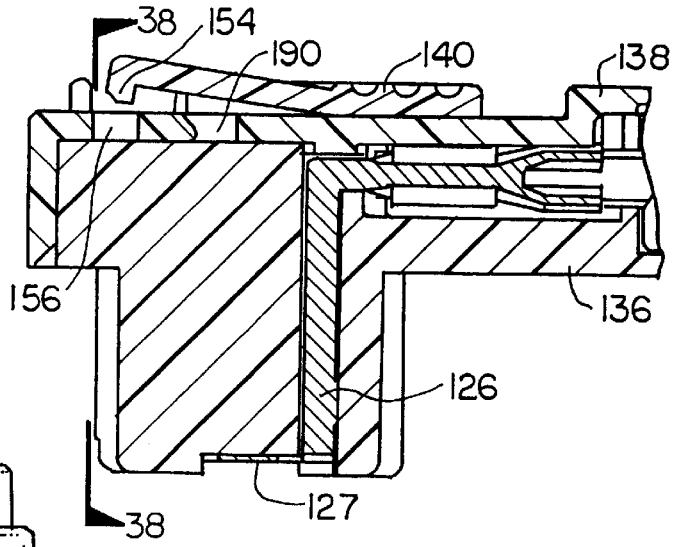
FIG. 39 is a partial cross-sectional view along line 37—37 of FIG. 30 showing deflection to allow the CPA to engage in the closed position.
Figure 38:
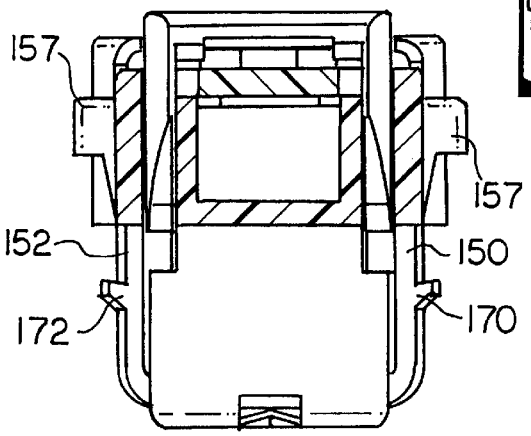
FIG. 38 is a cross-sectional view along line 38—38 of FIG. 39.
Figure 41:
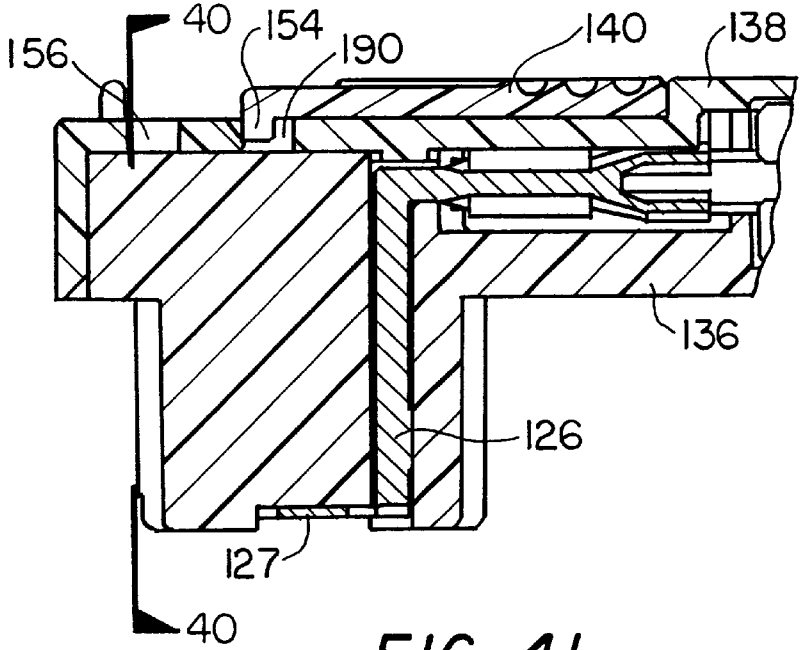
FIG. 41 is a cross-sectional view along line 37—37 of FIG. 30 showing the connector and CPA engaged.
Figure 40:
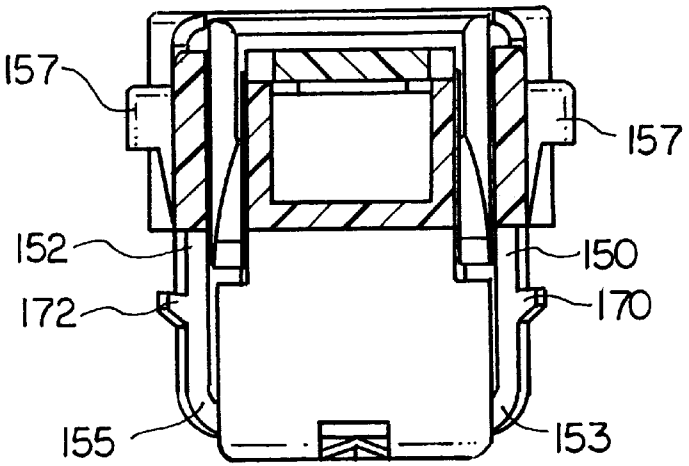
FIG. 40 is a cross-sectional view along line 40—40 of FIG. 41.
Figure 42:
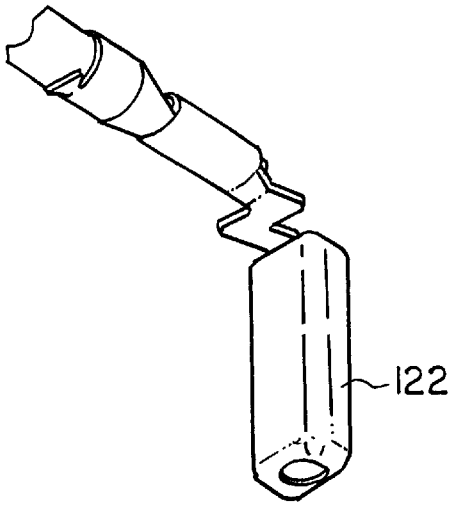
FIG. 42 is an isometric view of the female terminal of the connector of FIG. 20.
Figure 43:
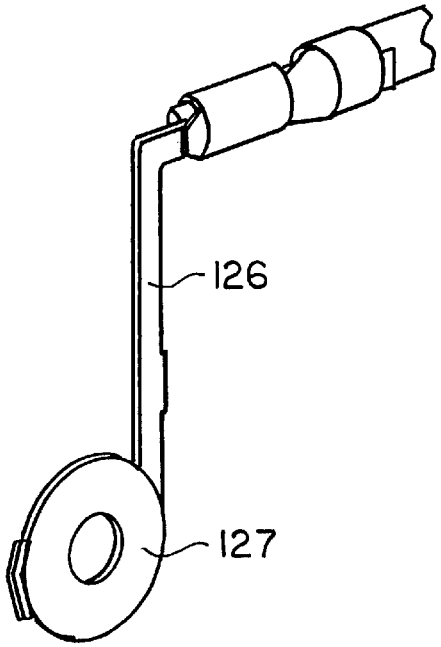
FIG. 43 is an isometric view of the ground terminal of the connector of FIG. 20 prior to bending of the contacting ring into position.
Figure 44:
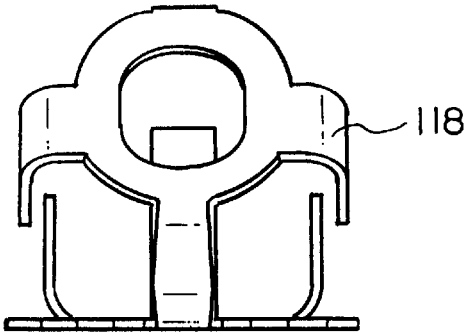
FIG. 44 is a side view of a grounding clip.

The CPA 140 is slidable between an open position (FIG. 37) and a closed position (FIG. 41) and is retained on the housing by catches 181 (FIG. 24). When the connector has been engaged in the socket, the CPA 140 is slid toward the wire entrance area 159 into the closed position, in which depending arms 158 fit between the latching arms 150, 152 and the rest of the connector body. In this position, the CPA ensures correct positioning of the connector in the socket, and the depending arms 158 of the CPA block removal of the latching arms 150, 152 from the groove 120, so that the connector cannot be removed from the socket. To remove the connector, the CPA is slid in a direction away from the wire entrance area 159 to unblock the latching arms, whereupon the latching arms can be flexed inwardly to disengage the catches 170, 172 from the groove 120.

The CPA 140 also includes one or more catches or abutment member 154 depending from an underside of the CPA. See FIG. 37. The catches 154 fit within corresponding first notches or lockout portions 156 on the cover 138 of the connector body 136 when the connector is not inserted into a squib socket, preventing the CPA from being pushed into the closed position with respect to the connector. Full closure of the CPA is prevented when arms 150 and 152 are only partially mated since the arms interfere with arms 158. When the connector body is inserted into the squib socket, the top edge of the socket contacts the two depending arms 158 of the CPA 140, pushing the arms 158 upwardly and thereby displacing the catches 154 out of the first notches 156 on the cover. Once the catches no longer fit within the first notches, the CPA can be slid toward the wire entrance area 159 into the closed position in the connector body. In the closed position, the catches 154 fit within corresponding second notches 190 on the cover 138, to retain the CPA in the closed position.

The CPA 140 optionally includes a central beam 180 having a downwardly extending protrusion 182 on the end. See FIGS. 30 and 32. The protrusion fits within one of two corresponding depressions or apertures 184, 186 in the cover 138, depending on whether the CPA is in the open or closed position. The protrusion 182 limits travel of the CPA between the open and closed positions and provides an audible click as it enters the depressions 184, 186, so that a user can detect when the CPA has been fully moved into either the closed or open position.

The invention is not to be limited by what has been particularly shown and described, except as indicated by the appended claims.

We claim:

1. An orientationless squib connector for an automotive air bag assembly, the squib connector comprising:

a connector body having a cylindrical portion, defining a central axis, configured to fit in mating engagement within a squib socket, a first electrically conductive terminal symmetrically located around the central axis within the cylindrical portion, and a second electrically conductive terminal radially offset from the first electrically conductive terminal with respect to the central axis and comprising a depending beam having a contacting surface at a free end thereof;

a cover fixed to the connector body;

one of the connector body or the cover further including a lockout portion; and a connector position assurance member mounted on the connector body for movement between an open position and a closed position, the connector position assurance member further including an abutment member positioned to abut against the lockout portion of one of the connector body or the cover to prevent movement of the connector position assurance member out of the open position, one of the abutment member and the lockout portion configured to be deflectable upon insertion of the connector body into a socket to move the abutment member out of abutment with the lockout portion, whereby the connector position assurance member is movable to the closed position.

2. The orientationless squib connector of claim 1, wherein the connector body further includes a latching arm having a catch thereon disposed to fit within a groove of the socket.

3. The orientationless squib connector of claim 2, wherein the connector position assurance member includes a member disposed to fit between the latching arm and the connector body when the connector position assurance member is in the closed position.

4. The orientationless squib connector of claim 2, wherein the catch on the latching arm is disposed to fit in an external groove of the socket.

5. The orientationless squib connector of claim 2, wherein the catch on the latching arm is disposed to fit in an internal groove of the socket.

6. The orientationless squib connector of claim 1, further comprising an electrically conducting member movable between a first position, in which the electrically conducting member provides an electrical short between the first terminal and the second terminal, and a second position, in which the electrically conducting member is out of electrical contact with one of the first terminal and the second terminal.

7. The orientationless squib connector of claim 6, wherein the electrically conducting member comprises a flexural beam extending from the second terminal to the first terminal.

8. The orientationless squib connector of claim 7, wherein the first terminal further includes a pad area disposed to contact the flexural beam.

9. The orientationless squib connector of claim 7, wherein the connector position assurance member further includes an arm disposed to hold the flexural beam out of contact with the first terminal when the connector position assurance member is in the closed position.

10. The orientationless squib connector of claim 1, wherein the abutment member comprises an arm mounted to the connector position assurance member, and the lockout portion comprises a deflectable beam mounted to the connector body in a location to contact a surface of the socket upon insertion of the connector body into the socket to deflect the lockout portion out of contact with the abutment member.

11. The orientationless squib connector of claim 1, wherein the abutment member comprises a catch mounted on an underside of a flexural member of the connector position assurance member.

12. The orientationless squib connector of claim 11, further comprising an arm depending from the flexural member of the connector position assurance member and disposed to contact a surface of the socket upon insertion of the connector body into the socket to deflect the flexural member upwardly.

13. The orientationless squib connector of claim 12, wherein the lockout portion comprises a notch in the cover.

14. The orientationless squib connector of claim 1, wherein the connector position assurance member further includes a protrusion and the cover further includes a first depression sized to receive the protrusion in the open position and a second depression sized to receive the protrusion in the closed position.

15. The orientationless squib connector of claim 14, wherein the protrusion and the first and second depressions are further sized to provide an audible click upon movement of the protrusion into either of the first or second depressions.

16. The orientationless squib connector of claim 14, wherein the first and second protrusions are located to limit travel of the connector position assurance member between the open position and the closed position.

* * * * *

UNITED STATES PATENT AND TRADEMARK OFFICE

CERTIFICATE OF CORRECTION

PATENT NO. : 6,276,953 B1
DATED : August 21, 2001
INVENTOR(S) : Bradford K. Gauker et al.

It is certified that error appears in the above-identified patent and that said Letters Patent is hereby corrected as shown below:

Title page,
Item [57], ABSTRACT,
Line 1, “orientation less” should read -- orientationless --; and Column 4,
Line 21, “at 5 any” should read -- at any --.

Signed and Sealed this

Twenty-second Day of October, 2002

*Attest:*

*Attesting Officer*

JAMES E. ROGAN
*Director of the United States Patent and Trademark Office*